US006076203A

United States Patent [19]

Karhumaki

[11] Patent Number: 6,076,203

[45] **Date of Patent: *Jun. 20, 2000**

[54] BODY TREATMENT APPARATUS

[76] Inventor: Jorma Karhumaki, Partola-Keskus, FI-33950 Pirkkala, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/430,196

[22] Filed: Apr. 27, 1995

[30] Foreign Application Priority Data

Apr. 29, 1994 [FI] Finland ..... 941984

[51] Int. Cl.[7] ..... A61H 33/02

[52] U.S. Cl. ..... 4/533; 4/539; 4/540; 4/541.1; 4/590

[58] Field of Search ..... 4/540, 580, 590, 4/528, 529, 530, 541.3, 533, 539, 541.1, 584, 594

[56] References Cited

U.S. PATENT DOCUMENTS

| | | | |
|---|---|---|---|
| 786,127 | 3/1905 | Jordan | 4/528 |
| 1,500,557 | 7/1924 | Gorman | 4/540 X |
| 3,119,122 | 1/1964 | Weisbeck | 4/580 |
| 3,827,087 | 8/1974 | Cuthbertson | 4/540 |
| 3,924,278 | 12/1975 | Ekman | 4/540 |
| 4,160,292 | 7/1979 | Kuether et al. | 4/590 X |
| 4,546,505 | 10/1985 | Wakenshaw | 4/541.3 |
| 4,809,368 | 3/1989 | Johansson | 4/540 |
| 5,393,119 | 2/1995 | Mukai | 4/540 X |

*Primary Examiner*—Robert M. Fetsuga
*Attorney, Agent, or Firm*—James B. Middleton; Walter A. Rodgers

[57] ABSTRACT

A body treatment apparatus has two separate but contiguous tubs to provide selective treatment to the feet and the upper body. A person will sit in one tub, and the person's feet will be in the other tub. The knees will be over a dam separating the two tubs. Each tub has separate fluid inputs and separate drains, so each may receive different fluids, and at different times. The entire tub unit can be rotated between a position in which the person is in a sitting position, and a position in which the person is reclining, with the feet higher than the head. Covers are provided for use when desired, such as during steam treatment.

5 Claims, 2 Drawing Sheets

BODY TREATMENT APPARATUS

BACKGROUND OF THE INVENTION

1. Field of the Invention

This invention relates generally to body treatment apparatus, and is more particularly concerned with a dual tub treatment apparatus having multiple fluid inputs and drains.

2. Discussion of the Prior Art

There are numerous tubs and enclosures for body treatment purposes. The prior art tubs generally comprise containers for liquid, sometimes with means for re-circulating the liquid.

A dual tub arrangement is disclosed in Swedish Patent No. 409,646. The tub shown in the Swedish Patent includes a first tub for the feet of a person, the first tub being fixed at the lower edge of a second tub in which the person can sit. A drain is provided in the first tub. If desired, the dual tub arrangement can be tilted so that the person is in a generally reclining position, and the liquid will flow into both the first and the second tubs. The construction shown in the Swedish patent is quite complex, and does not appear to be reliable or durable.

Other prior art body treatment devices include cabinets for the application of steam, and enclosures for bathing disabled people. The steam cabinet is for just steam, and the enclosures for the disabled are simply means by which a seated person can be cleansed by showers and the like.

Thus, the prior art has not provided versatile body treatment apparatus for allowing multiple treatments in multiple body positions.

SUMMARY OF THE INVENTION

The present invention provides a unitary treatment apparatus comprising two separate tubs for receiving two separate portions of the body. Each tub of the two separate tubs has individual fluid inlets and fluid outlets, so the two tubs can receive fluid or not, individually; and, the two tubs may receive different fluids. The separate drains allow separate fluids to be drained separately, and recirculated, if desired.

The arrangement for the apparatus of the present invention is such that a person can be in a seated position, or in a reclining position. When in a seated position, the person can be treated with gaseous fluids such as steam or the like, and some liquid; and, when in a reclining position, the person can be treated with liquids or gases or both.

In the preferred embodiment of the invention, the apparatus of the present invention includes covers for enclosing the apparatus when desired, for example to enclose steam within the apparatus. Also, the apparatus includes hinged supports to allow the rotation of the apparatus from the position wherein a person is seated to the position wherein a person is reclining, and including a position wherein the feet are higher than the head.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
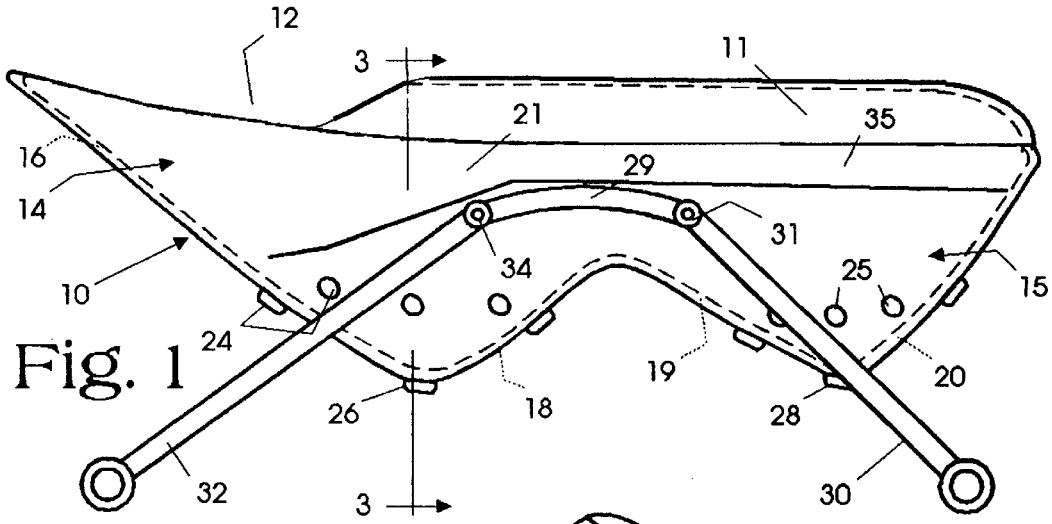
FIG. 1 is a side elevational view showing a body treatment apparatus made in accordance with the present invention, the device being in the position to allow a person to recline.

Referring now more particularly to the drawings, and to that embodiment of the invention here presented by way of illustration, the apparatus shown in FIG. 1 comprises a tub unit 10 having a cover 11. The cover 11 extends over the majority of the tub unit 10, leaving an open portion 12 at one end of the unit 10. The cover will be described in more detail hereinafter.

The tub unit 10 comprises a first tub 14 and a second tub 15. The first tub 14 includes a back rest 16 and a seat 18, and the second tub 15 includes a leg rest portion 19 and a foot rest portion 20. The back rest 16 and seat 18 are angularly related to form a comfortable seat for a person; so, when the tub unit 10 is in a horizontal, or reclining, position as shown in FIG. 1, the seat 18 extends upwardly. The leg rest portion 19 merges with the seat 18, and extends down to the foot rest portion 20. As a result of this construction, there is an upwardly extending section of the bottom of the tub unit 10 that separates the two tubs 14 and 15. This upwardly extending section consists of the seat 18 and the leg rest portion 19, but can also be thought of as a dam between the two tubs.

The tub unit 10 includes side walls that conform to the shape of the bottom described above. The sides walls are designated at 21 and 22, and are here shown as being formed integrally with the bottom of the tub unit 10.

The tubs 14 and 15 have fluid inlets for the introduction of fluids to the apparatus of the present invention. The tub 14 has inlets 24 spaced therearound. As here shown, there are inlets 24 in both sides 21 and 22, and in the back rest 16 and seat 18. Those skilled in the art will understand that the inlets 24 can be relocated, and/or additional inlets can be added if desired. Similarly, the tub 15 has inlets 25 spaced therearound. Variations in the number and placement of the inlets 25 can be made as desired.

Each of the tubs 14 and 15 has a drain, or fluid outlet, at the lowest portion thereof, when the tub unit 19 is in the reclining position. The drain for the tub 14 is shown at 26, and the drain for the tub 15 is shown at 28.

The support means for the tub unit 10 is here shown as including a mounting member 29 having a pair of legs pivoted to each end thereof. For convenience of discussion, the end of the tub unit 10 including the back rest 16 will be referred to as the top, and the end including the foot rest 20 will be referred to as the bottom. Those skilled in the art will understand that the top and bottom are interchangeable mechanically, and this nomenclature is for convenience only, without limiting the scope of the present invention.

Figure 2:
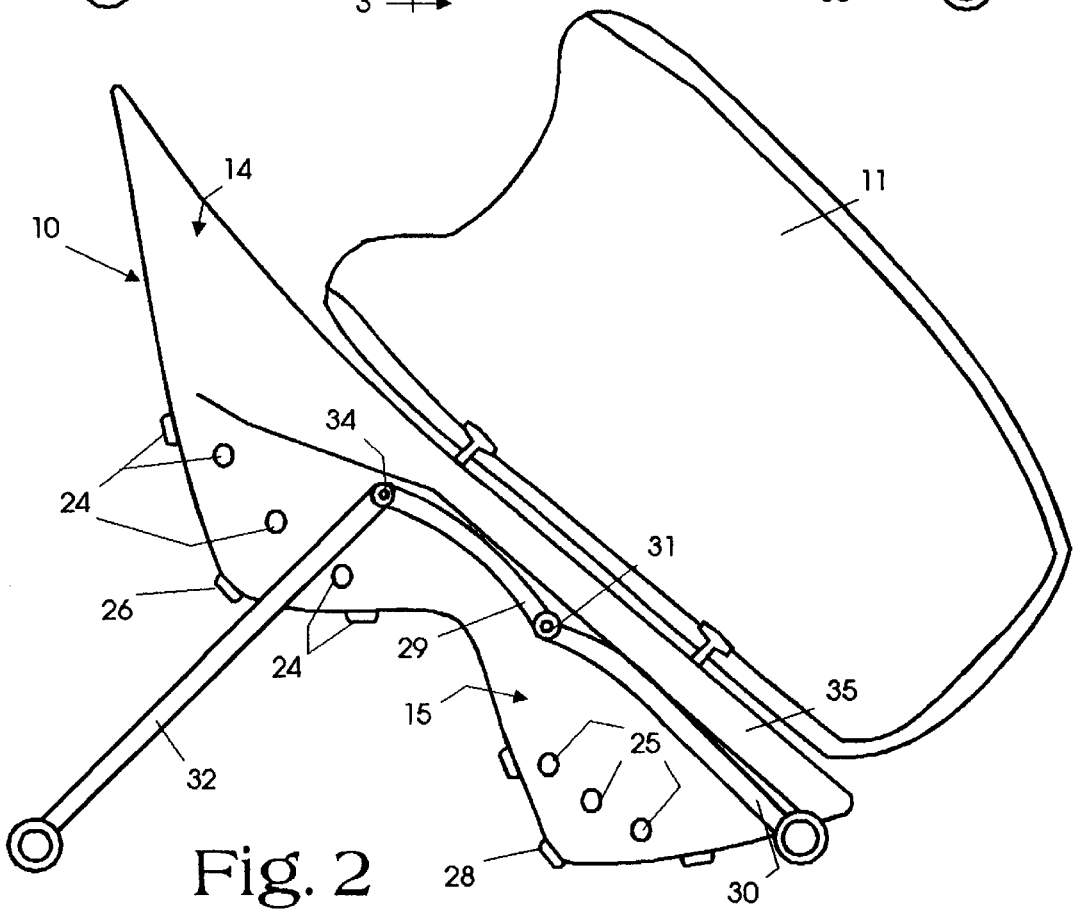
FIG. 2 is a view similar to FIG. 1, but showing the apparatus in position for a person to be in a seated position, and having the cover open.
Figure 3:
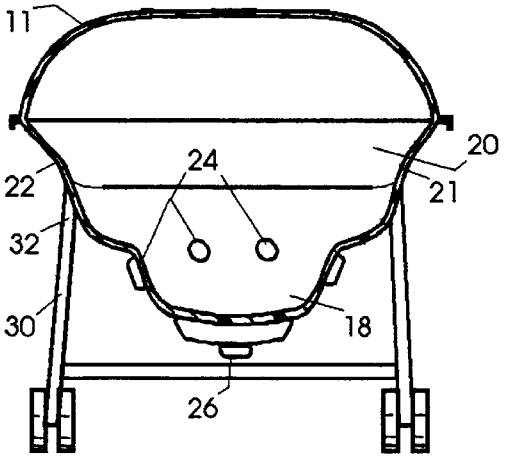
FIG. 3 is a cross-sectional view taken along the line 3—3 in FIG. 1; and, FIG. 4 is a view similar to FIG. 1, but including an upper cover, and a fluid control unit for the apparatus, connections being shown schematically.

Looking at FIGS. 1 and 2, it will be seen that the mounting member 29 is fixed with respect to the tub unit 10, and a pair of bottom legs 30 is pivoted to the mounting member 29 at 31. A pair of top 32 legs is pivoted to the opposite end of the mounting member 29 at 34. Comparison of the two figures will show that the tub unit 10 can easily be shifted from the reclining position shown in FIG. 1 to the sitting position shown in FIG. 2. From the reclining position shown in FIG. 1, the bottom legs 30 are pivoted towards the bottom of the device, perhaps until the legs 30 engage the ridge 35 of the tub unit 10. Similarly, the top legs 32 are pivoted in the direction of the bottom of the tub unit.

Those skilled in the art will understand that various means for causing the pivoting of the legs 30 and 32 can be utilized. One might require manual movement of the legs, and have locking joints, or additional linkages to hold the legs in the desired positions. Alternatively, one might utilize an electric motor fixed to the tub unit 10 with linkages extending to the legs 30 and 32 for adjustment as desired. Either arrangement requires only routine mechanical apparatus, and no further discussion is thought to be necessary.

The cover 11 is shown in closed position in FIG. 1 and in open position in FIG. 2. It will be noticed that, in closed position, the cover 11 extends over the bottom portion of the tub unit 10, and leaves an opening at the top of the unit 10. Thus, a person in the tub unit 10 can have most of the unit closed, but have the face open.

Figure 4:
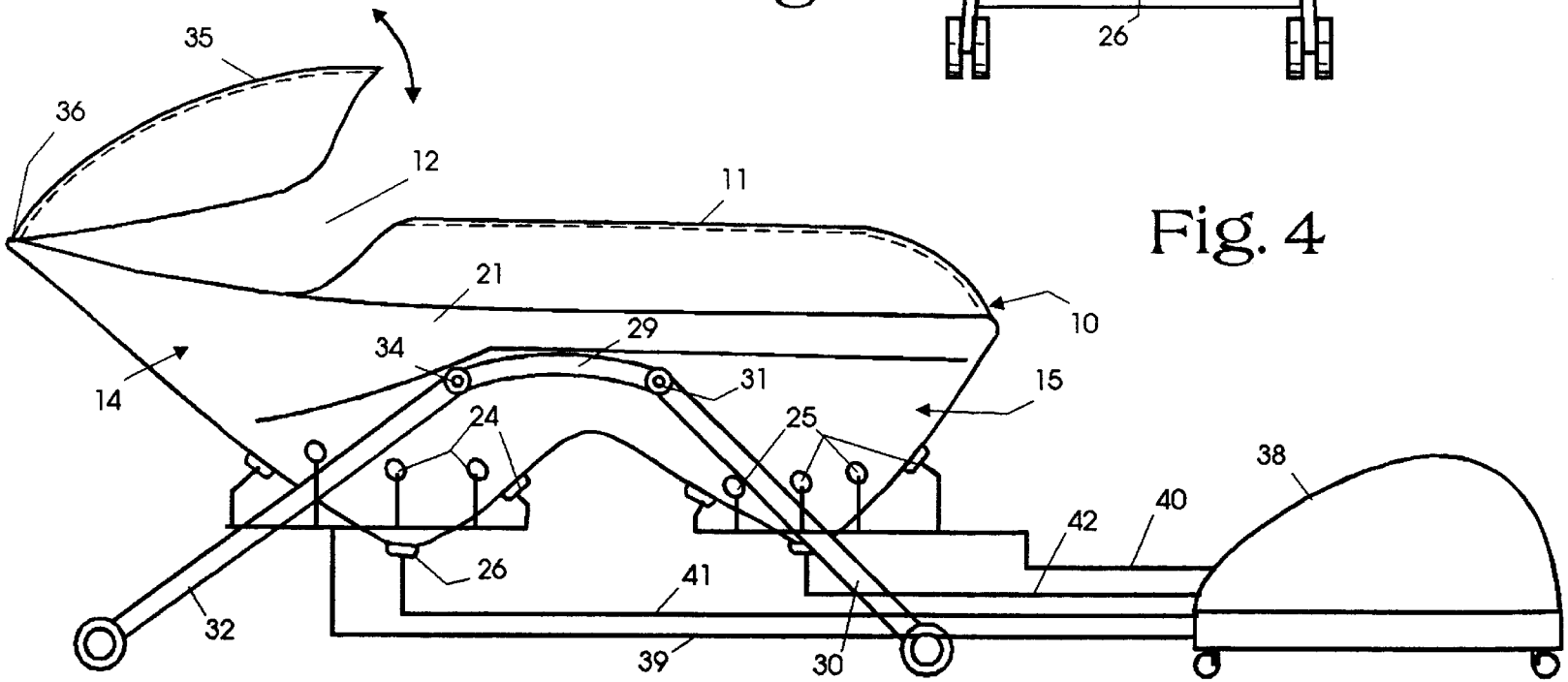

FIG. 4 of the drawings shows the tub unit 10 in reclining position, and with the addition of an upper cover 35. The upper cover 35 is hinged to the upper end of the tub unit 10 as at 36; and, the upper cover 35 is complementary to the cover 11. Thus, with both covers 11 and 35 closed, the tub unit 10 is completely enclosed. This may be desirable for steam treatment or the like.

FIG. 4 also illustrates a control unit for supplying fluids to the treatment apparatus, and for draining fluids therefrom. It will be noticed that the control unit 38 includes separate lines 39 and 40 for supplying fluid to the first tub 14 and the second tub 15 respectively, and separate lines 41 and 42 for draining fluids from the first and second tubs respectively. With this arrangement, it will be realized that great versatility in treatment is possible. For example, different liquids can be placed in the two separate tubs 14 and 15, and they may be supplied and drained at different times as desired. Also, liquid may fill one tub while only steam is supplied to the other; or, liquid can fill one or both tubs, while air or other gas is supplied to one or both to provide agitation of the liquid. While not here illustrated, those skilled in the art will understand that each of the lines 39–42 includes appropriate valving to achieve the control described.

With the above and foregoing description in mind, it will be understood that the apparatus of the present invention provides a highly versatile body treatment apparatus. The apparatus allows a person to be in a sitting position, in a fully reclining position with head higher or with feet higher, or any position between these two, simply by pivoting the legs 30 and 32 with respect to the tub unit 10.

When the tub unit 10 is in the sitting position, it is possible that the cover 11 will seal tightly to allow the second tub 15 to be filled with liquid. Otherwise, one would supply only gases to the unit while in the full sitting position. It will be understood, however, that the tub unit 10 may be tilted slightly so some liquid can be placed into the tub 15 for foot treatment.

When the tub unit is in the reclining position, the two separate tubs 14 and 15 can be filled with liquid if desired. Further, each tub can be filled with a different liquid if desired. Additionally, a gas can be admitted to each tub, either in addition to the liquid, or in lieu thereof, depending on the selected treatment.

It will of course be understood by those skilled in the art that the particular embodiment of the invention here presented is by way of illustration only, and is meant to be in no way restrictive; therefore, numerous changes and modifications may be made and the full use of equivalents resorted to without departing from the spirit or scope of the invention as outlined in the appended claims.

I claim:

1. Body treatment apparatus comprising a tub unit including a first tub and a second tub, said first tub including a seat portion and a back rest joined to define a lowest portion of said first tub, said second tub including a leg rest and a foot rest joined to define a lowest portion of said second tub, said seat portion and said leg rest being adjacent to each other and forming a dam in said tub unit for separating said first tub from said second tub, first inlet means for supplying fluid to said first tub, second inlet means for supplying fluid to said second tub, first outlet means for draining fluid from said first tub, separate second outlet means for draining fluid from said second tub, means for rotating said tub unit between a first position wherein a person on said seat portion is in a sitting position and a second position wherein a person on said seat portion is in a reclining position, said first outlet means and said second outlet means being on said lowest portions of said first tub and said second tub when said tub unit is in said second position, and control means for selectively supplying differening liquids and gases to said first and second inlet means and selectively draining said liquids and gases from said outlet means of said tub unit.

2. Body treatment apparatus as claimed in claim 1, and further including cover means for partially enclosing a person within said tub unit.

3. Body treatment apparatus as claimed in claim 2, and further including a complementary cover such that said cover means and said complementary cover completely enclose said tub unit.

4. Body treatment apparatus as claimed in claim 1, wherein said means for rotating said tub unit comprises a first pair of legs supporting one end of said tub unit, and a second pair of legs supporting the opposite end of said tub unit, and means for pivoting said first and second pairs of legs with respect to said tub unit.

5. Body treatment apparatus as claimed in claim 1, and further including said first and said second inlet means each comprising multiple inlets for providing treatment to different portions of said body.

* * * * *